United States Patent [19]

Davies

[11] Patent Number: 4,475,869

[45] Date of Patent: Oct. 9, 1984

[54] GAS TURBINE ENGINE AND SHAFT

[75] Inventor: Kenneth G. Davies, Derby, England

[73] Assignee: Rolls-Royce Limited, London, England

[21] Appl. No.: 436,334

[22] Filed: Oct. 22, 1982

[30] Foreign Application Priority Data

Nov. 12, 1981 [GB] United Kingdom ..... 8134109

[51] Int. Cl.[3] ..... F01D 5/02

[52] U.S. Cl. ..... 416/170 R; 415/140; 415/107; 384/425; 416/2

[58] Field of Search ..... 415/61, 107, 140, 141, 415/170 R, 9; 416/170 R, 2, 172; 308/174; 384/424–428; 60/226.2

[56] References Cited

U.S. PATENT DOCUMENTS

| | | | |
|---|---|---|---|
| 3,225,698 | 12/1965 | Spisiak | 415/140 X |
| 4,073,731 | 2/1978 | Fanta | 308/174 X |
| 4,201,426 | 5/1980 | Garten et al. | 415/170 R X |
| 4,201,513 | 5/1980 | Sales | 416/170 R X |

FOREIGN PATENT DOCUMENTS

| | | | |
|---|---|---|---|
| 1300352 | 7/1969 | Fed. Rep. of Germany | 416/170 R |
| 1128292 | 1/1957 | France | 415/140 |
| 521722 | 3/1955 | Italy | 415/170 R |
| 1202692 | 7/1966 | United Kingdom . | |
| 1131883 | 4/1967 | United Kingdom . | |
| 1135129 | 9/1967 | United Kingdom . | |
| 1205419 | 12/1967 | United Kingdom . | |
| 1232085 | 6/1968 | United Kingdom . | |
| 1455608 | 2/1974 | United Kingdom . | |

*Primary Examiner*—Abraham Hershkovitz
*Assistant Examiner*—Joseph M. Pitko
*Attorney, Agent, or Firm*—Cushman, Darby & Cushman

[57] ABSTRACT

The front fan of a ducted fan gas turbine engine is connected to the low pressure turbine of the gas generator by a shaft so as to be driven thereby. If the shaft breaks, air loads on the fan tend to pull it from the engine. It is known to provide a fail/safe shaft over and above the normal shaft which is retained at one end by some means and has a flange on its upstream end, to retain the fan via its disc. The invention obviates the heavy and expensive fail/safe shaft and substitutes a first annular shoulder 40 on the inner race of the fan bearing 20 and a further shoulder 42 on fixed structure 38. If the fan attempts to exit the engine, the two shoulders 40, 42 engage and so retain the fan.

2 Claims, 2 Drawing Figures

GAS TURBINE ENGINE AND SHAFT

FIELD OF INVENTION

This invention concerns a gas turbine engine and shaft. More particularly the invention relates to an engine having a shaft which connects a turbine stage and front fan stage.

BRIEF SUMMARY OF THE INVENTION

According to the present invention, a gas turbine engine includes a front fan connected for driving by a low pressure turbine stage via a shaft which is supported intermediate its ends in a ball bearing and adjacent its upstream end in a roller bearing, said shaft and the inner race of the roller bearing being rigidly connected so as to effectively provide an integral unit and including a first annular shoulder on the upstream end of said inner race, a further annular shoulder formed on non-rotary structure which supports the outer race of said roller bearing and axially aligned with said first annular shoulder at a position upstream thereof, such that in the event of excessive movement of said shaft in an upstream direction, said first and further annular shoulders engage and prevent further such movement.

The shaft may be formed by coaxially assembling a number of short shafts so as to transmit rotary drive via their connections.

The invention will now be described, by way of example and with reference to the accompanying drawings in which:

DETAIL DESCRIPTION OF THE INVENTION

Figure 1:
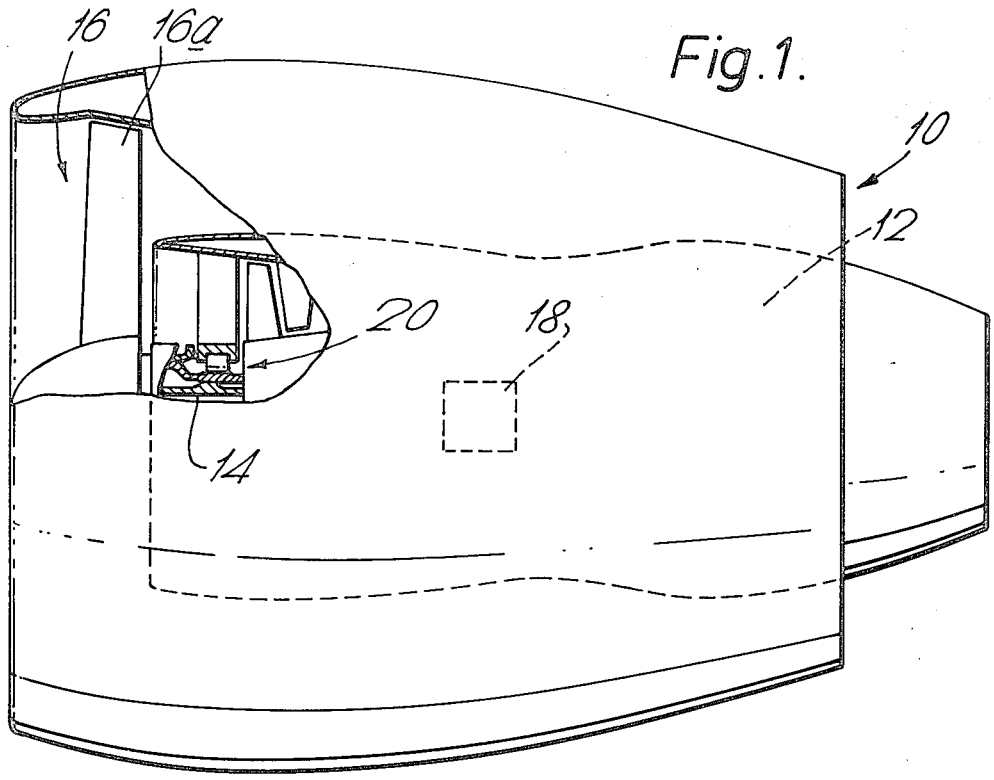
FIG. 1 is a diagrammatic view of a gas turbine engine incorporating a front fan.

Referring to FIG. 1. A gas turbine engine 10 has a core gas generator 12, the low pressure turbine (not shown) of which, is connected by a shaft 14, to drive a front fan 16.

Shaft 14 may be a single piece shaft, or it may consist of a number (up to three) of stub shafts (not shown) coupled together. In any event, its length is sufficient to warrant its support via a ball bearing (not shown) in a position intermediate its ends, as diagrammatically illustrated by the slotted square 18.

Shaft 14 is also supported in bearing structures at each end. Only one such structure, 20, is shown, that being at the upstream end of shaft 14. By upsteam is meant, in relation to the direction of the flow of fluids through the gas turbine engine 10.

Figure 2:
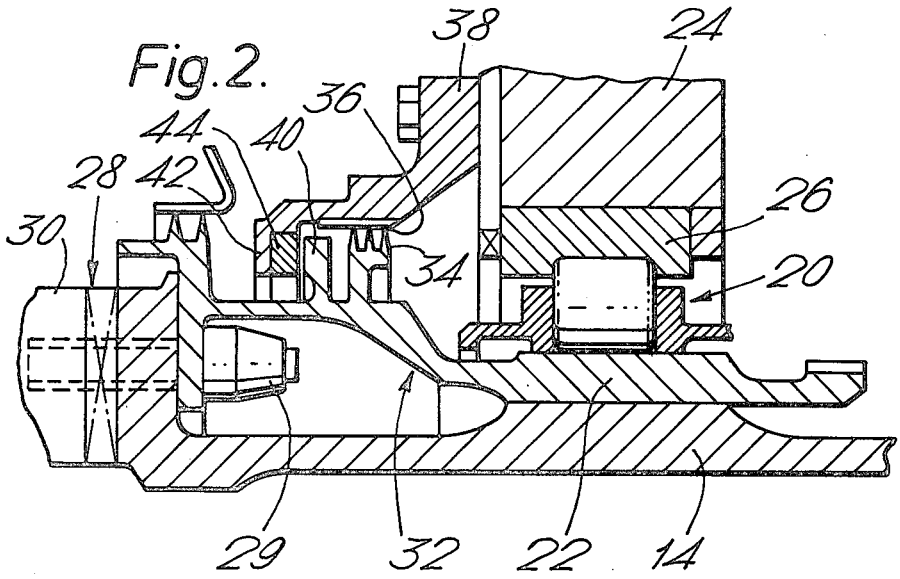
FIG. 2 is an enlarged part view of FIG. 1.

Referring now to FIG. 2. Shaft 14 integrally supports the inner race 22 of bearing 20, in close fitting relationship. A fixed bearing housing 24 supports the outer race 26 of bearing 20.

Shaft 14 is fitted in end on relationship by a dog and slot arrangement of the kind known as a curvic coupling to stub shaft 30 by bolts 29, the stub shaft 30 being on the disc (not shown) which supports fan blades 16*a*.

Inner race 22 has an annular extension or portion 32 extending in an upstream direction. Portion or extension 32 in turn has a labyrinth seal 34 formed therein which, with a land of abrasive material 36 carried by an annular extension of fixed structure 38, provides a seal against oil leakage.

Annular extension or portion 32 carries a further outwardly turned annular shoulder or land 40 and fixed structure 38 also carries an inwardly turned annular shoulder or land 42, which is axially aligned with land 40 and is of diametrically similar proportions thereto.

Annular land 42 may include an annular shoulder or carbon ring 44, to act as an energy absorber, should the two shoulders 40 and 42 engage. It is not however, essential.

If, for any reason, shaft 14 breaks or separates and vibration monitoring apparatus (not shown) does not, record the vibrations which result from the separation, air loads on the fan 16 will tend to pull fan 16 out of engine 10.

On movement of shaft 14 in an upstream direction, as a result of its separation, annular shoulder or land 40 engages with annular shoulder or land 42, or carbon ring 44 if one is provided, and so shaft 14 is prevented from further axial movement.

Separation of shaft 14 obviates the drive from the turbine. The air loads mentioned hereinbefore, are consequently quickly nullified and then reversed, as the forward speed of the aircraft (not shown) in which engine 10 is mounted for operation, causes incoming air to act in fan 16 as do gases on a turbine.

During normal operation of engine 10, axial loads generated internally of engine 10 bring about some axial movement of shaft 14. It follows that shoulders or lands 40 and 42 must be spaced from each other, a distance sufficient to ensure that undesirable engagement does not occur.

I claim:

1. A gas turbine engine comprising;

a drive shaft having an upstream end;

a front fan connected to said upstream end of said drive shaft for driven rotation thereby;

a roller bearing assembly supporting said upstream end of said drive shaft, said roller bearing assembly including an inner race integrally fixed to said upstream end of said drive shaft, an outer race, and roller bearings therebetween, said inner race having an annular extension extending upstream therefrom, said annular extension having an outwardly turned annular shoulder intermediate ends thereof; and non-rotary fixed structure supporting said outer race, said non-rotary fixed structure having an annular extension extending upstream of the same and having an inwardly turned annular shoulder axially aligned with and immediately upstream of said outwardly turned annular shoulder whereby upon occurrence of an excessive axial movement of said front fan and said drive shaft in an upstream direction, said inwardly turned annular shoulder and said outwardly turned annular shoulder abut each other and arrest said axial movement.

2. A gas turbine engine as claimed in claim 1 wherein one of said inwardly turned annular shoulder and said outwardly turned annular shoulder support a carbon ring for engagement with the other shoulder on occurrence of said excessive movement of the drive shaft.

* * * * *